United States Patent [19]

Straus

[11] Patent Number: 4,937,888

[45] Date of Patent: Jul. 3, 1990

[54] HELMET COVER

[76] Inventor: Albert E. Straus, 3740 Stirrup Dr., Erie, Pa. 16506

[21] Appl. No.: 200,526

[22] Filed: May 31, 1988

[51] Int. Cl.[5] ..... A42B 3/00; A63B 71/10

[52] U.S. Cl. ..... 2/411; 2/425

[58] Field of Search ..... 2/410, 411, 412, 413, 2/424, 425, 414

[56] References Cited

U.S. PATENT DOCUMENTS

| | | | |
|---|---|---|---|
| 2,296,335 | 9/1942 | Brady | 2/412 |
| 3,128,095 | 4/1964 | Sharkey | 2/410 X |
| 3,174,155 | 3/1965 | Pitman | 2/411 |
| 3,242,500 | 3/1966 | Derr | 2/412 |
| 3,435,460 | 4/1969 | Grant | 2/422 |
| 3,818,508 | 6/1974 | Lammers et al. | 2/412 |
| 3,859,666 | 1/1975 | Marietta et al. | 2/412 |
| 3,992,722 | 11/1976 | Rhee | 2/424 |
| 4,307,471 | 12/1981 | Lovell | 2/411 |
| 4,599,752 | 7/1986 | Mitchell | 2/425 |
| 4,660,230 | 4/1987 | Mayling | 2/413 |
| 4,692,947 | 9/1987 | Black et al. | 2/425 |

FOREIGN PATENT DOCUMENTS

| | | | |
|---|---|---|---|
| 2941019 | 4/1981 | Fed. Rep. of Germany | 2/410 |
| 1374284 | 8/1964 | France | 2/411 |
| 343002 | 9/1936 | Italy | 2/421 |

*Primary Examiner*—Wm. Carter Reynolds

*Attorney, Agent, or Firm*—Charles L. Lovercheck; Wayne L. Lovercheck; Dale R. Lovercheck

[57] ABSTRACT

Apparatus for protecting the wearer of a helmet in the form of an elastomeric cellular helmet cover, encased in an integral shell of like material, that can be attached to the exterior of an unmodified helmet, by means of flexible tabs, to reduce the potential for injury to the wearer. The helmet cover is configured so that it is thicker in the area where impact is customarily greater, and greater resilience is provided at these points. The helmet cover is sufficiently thick at the front to protrude forward at the edge of the helmet and a face guard attaching parts. The wearer is therefore protected and those contacted by the helmet during the game are also protected.

20 Claims, 2 Drawing Sheets

HELMET COVER

BACKGROUND OF THE INVENTION

The present invention relates to head protecting equipment and more particularly to an apparatus for absorbing a part of the total energy that would be imparted to the wearer's head by a particular impact with another person or object.

Injuries to athletes who participate in contact sports such as football are statistically on the increase. Numerous articles have recently appeared in sports publications discussing this increase in sports-related injuries, and many of these articles have expressed concern for the number of injuries related to the sport of football. While considerable protective equipment is already worn by athletes participating in the sport of football, it has been observed that while this protective equipment protects the wearer, it may also be used by the player to inflict injury on other players. Further, even when wearing the protective equipment presently available, the energy imparted to this equipment is transmitted to the body which is therefore subject to injury. These conditions usually occur as results of a player's head coming into contact with the body of another player. These types of forces to the player's head can occur anytime during the course of an athletic event; however, head injuries frequently occur when two players are mismatched and a stronger, bigger player is able to impart injury to the head of a smaller player as in blocking and tackling.

Football players typically wear protective head equipment or a helmet to protect the head. Such a helmet generally transmits, rather than absorbing energy, imparted by one player to another. Players also typically wear protective shoulder equipment to protect their shoulders and chest. This equipment also does not limit injury that may occur to the head and body of the players. Padding has been proposed to protect the player's head in response to forces applied to the front or top of the head, however, most of this equipment is directed to protecting the head from an external force rather than absorbing a part or all of these impact forces.

STATEMENT OF THE INVENTION

The purpose of this invention is to provide an improved helmet pad that will absorb energy and reduce the number and severity of head injuries to helmeted athletes. This is achieved by molding an elastomeric, cellular cap or cover encased in a durable, relatively light weight, flexible, resilient, integral skin with integral tabs molded to the cover. The cellular material has a density of at least four pounds per cubic foot. The cover can be affixed to the exterior of a helmet and held in place by relatively thin integral tabs. The cover is attached to the helmet in a manner that adds significantly to the protection given to the wearer that is already provided by a helmet.

Football helmets are referred to specifically in this disclosure, however, any helmet can be fitted with the helmet cover disclosed. The hard exterior of the helmet cover and an interior padding of the cover have the ability to absorb a certain amount of impact energy. In case of impact, the energy of the impact that is not absorbed by the interior padding is transferred to the skull of the player, resulting in injury, ranging from mild concussion to severe brain injury or other injury. By adding the molded soft outer helmet cover to the existing helmet, the injury potential becomes much less. The helmet cover is designed to reduce the number and severity of head injuries to helmeted athletes, for example, in the sports of football, ice hockey, polo and motorcycle riding.

The material can be held to the helmet cover by the Velcro on the tabs and compatible Velcro on the helmet adds significantly to the protection to the player and enhances the protection provided by the helmet itself. Not only is the wearer protected, but other players contacting the helmet are protected from it. Injury may occur when the helmet's hard outer surface impacts against another player. Therefore, another objective is to protect other players from possible injury such as fractured ribs, ruptured spleens or broken thumbs.

Because the helmet cover is molded as a unit, it can be custom molded to be fitted to any new or used helmet. This makes it possible for any existing helmet to be economically made much safer than if it were used without the cover.

The protective helmet cover has its own integral, tough, durable, low friction, high abrasion resistant skin integrally attached to and surrounding a resilient, cellular interior which absorbs shock. Interior configuration is such that it can fit an existing helmets' exterior shell. Since the exterior of the configuration provides an increased surface area thereby distributing any impact force over a wider area, thereby reducing transmitted stress by the increased area. It is softly curved for the same reason. It is also configured so as to visually disguise the fact that it is an add-on. The cover appears as a compatible part of the athlete's uniform.

The cover overlies only the area of the helmet that ordinarily impacts objects and persons. This reduces weight and cost. The cellular structure also reduces weight, while providing increased resiliency.

Tests were conducted on May 21, 1987 by the National Operating Committee on Standards for Athletes Equipment (NOCSAE) on a cap like that disclosed herein made of urethane foam having a density of about eight pounds per cubic foot.

The tests consisted of making three six-foot drops of a football helmet without a cap, according to the invention, and three drops of a helmet with the inventor's cap.

The three successive drops without the inventor's cap showed less impact absorption by the helmet. With the inventor's cap the impact absorbtion by the helmet remained constant. It took approximately five minutes to conduct the test with the inventor's cap and another five minutes to conduct the test without the inventor's cap.

As shown in the tests, the inventor's cap extends the time required to reach peak impact, as well as reduce the peak amount of impact and maintains its resiliency for successive impacts.

The tests were made on the helmet equipped with an electronic transducer connected to a cathode ray oscilliscope and the above graoh is a photograph of the oscilliscope tube.

REFERENCE TO PRIOR ART

Applicant is aware of the following patents:

U.S. Pat. No. 1,714,275 to Mullins
U.S. Pat. No. 1,859,313 to Pereles
U.S. Pat. No. 2,381,524 to Taylor
U.S. Pat. No. 2,634,415 to Turner et al U.S. Pat. No. 2,296,335 to Brady
U.S. Pat. No. 3,082,427 to Zbikowski
U.S. Pat. No. 3,174,155 to Pitman
U.S. Pat. No. 4,319,362 to Ettinger
U.S. Pat. No. 4,633,530 to Satterfield None of the above patents show a protective cover for a helmet having a resilient material encased in an integral skin with integral tabs for securing the cover to a helmet.

U.S. Pat. No. 2,296,335 to Brady shows a helmet pad made of sponge with a shell that is recessed into a helmet.

The pad of U.S. Pat. No. 2,381,524 to Taylor is held in place by a draw string.

The cover on the helmet of U.S. Pat. No. 3,174,155 to Pitman is held to the helmet by turning the cover edges over the edge of the helmet.

No patent shows an encased foam cover with integral tabs. Applicant's integral tabs effectively hold the cover in place, yet do not result in unsightly, uncomforatable, ineffective fastening means like the '155 Patent.

OBJECTS OF THE INVENTION

More specifically, it is an object of the invention to provide an improved helmet covering.

Another object of the invention is to provide a helmet covering that is held in place by tabs that are a continuation of the outer skin of the covering.

Another object of the invention is to provide a helmet covering made of resilient foam material that is surrounded by an integral skin that is tough, durable, has low coefficient of friction and high abrasion resistance.

Another object of the invention is to provide a helmet cover consisting of resilient material encased in an inner and an outer skin, having integral tabs for attaching the cover to a helmet.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWINGS

DETAILED DESCRIPTION OF THE DRAWINGS

Figure 1:
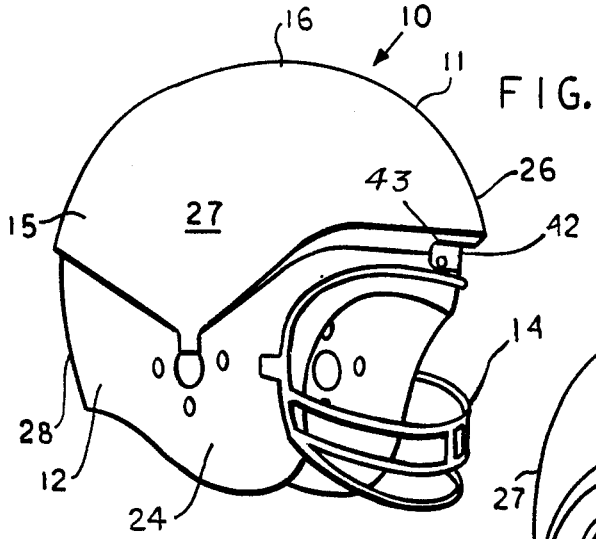
FIG. 1 is a front isometric view of the helmet cover, according to the invention, shown in combination with an athletic helmet.
Figure 2:
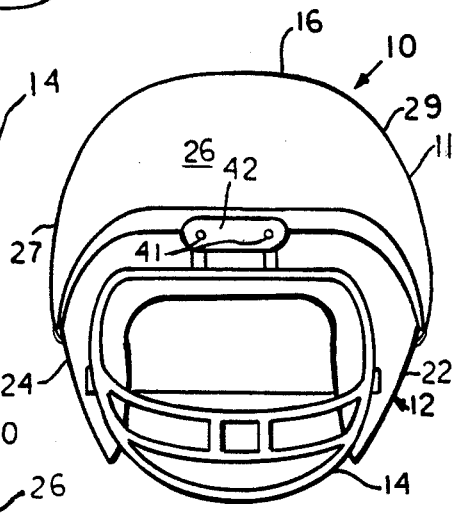
FIG. 2 is a front view of the helmet cover, on a helmet, according to the invention.
Figure 3:
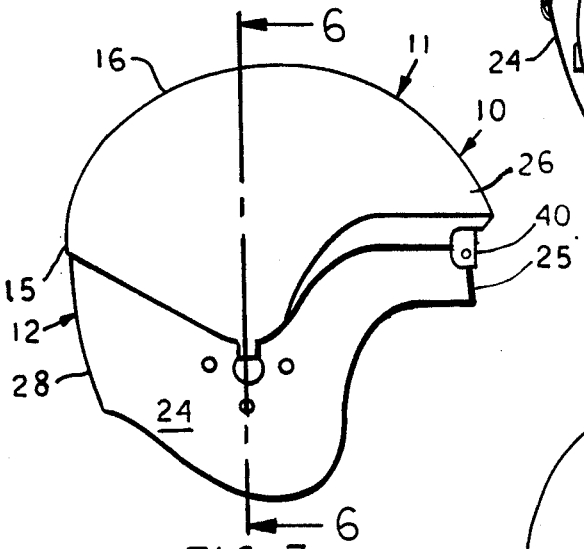
FIG. 3 is a side view of the helmet cover on a helmet.
Figure 4:
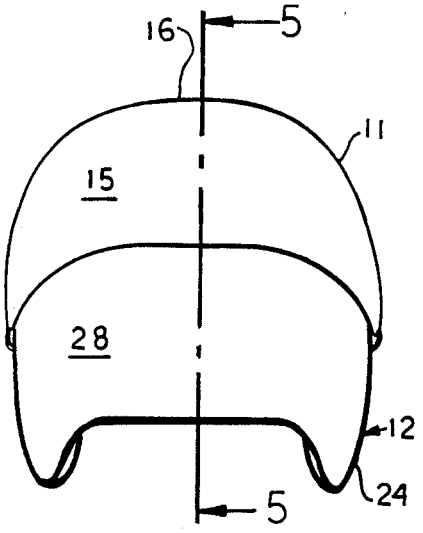
FIG. 4 is a rear view of the helmet cover, according to the invention, shown on a helmet.
Figure 5:
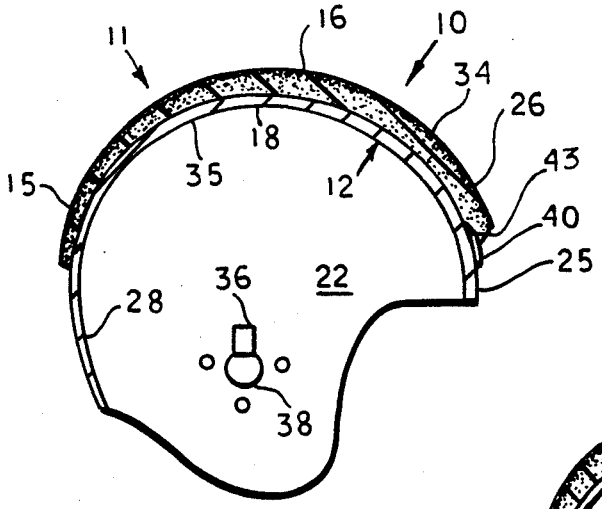
FIG. 5 is a longitudinal cross sectional view of the helmet cover taken on line 5—5 of FIG. 4, according to the invention.
Figure 6:
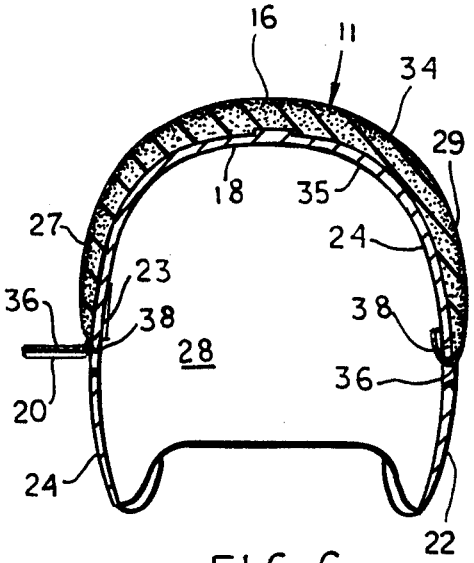
FIG. 6 is a cross sectional view taken on line 6—6 of FIG. 3.
Figure 7:
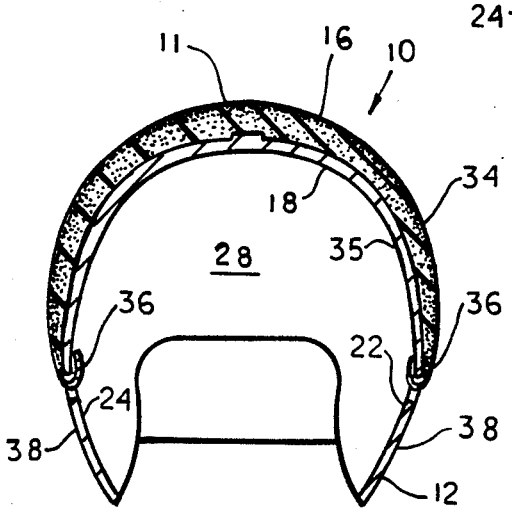
FIG. 7 is a cross sectional view, similar to FIG. 6, showing both helmet ear tabs in place attached to the helmet.
Figure 8:
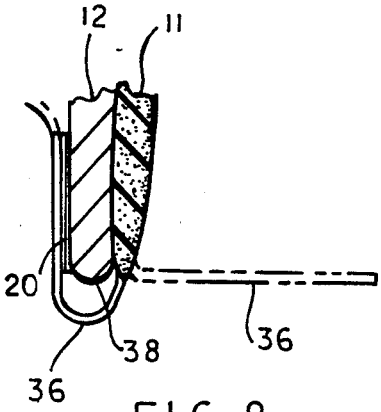
FIG. 8 is a partial enlarged view of the helmet showing one side tab, in full lines, extending through an ear ventilation hole, and one of the tabs extended, shown in phantom lines.

Now with more particular reference to the drawings, I show a combination 10 of a molded soft exterior helmet cover 11 and a helmet 12. The helmet cover is generally similar to a skull cap and it fits over the top of an athlete's helmet or similar device. The helmet cover is preferably molded from an elastomeric cellular material, such as urethane, with an integral outer skin 34 and integral inner skin 35 of like material that is durable, has low frictional co-efficient, high abrasion resistance, can be attached to a helmet by means of integral tabs 36 and 40.

Integral extension of outer skin 34 form Tabs 36 and 40 are integral Extensions of outer skin 34 of helmet cover 11 and, may be, for example, flexible and two inches long and three fourths inches wide, approximately 0.060 inches thick. The front tab 40 is recessed into the helmet cover at 43 so that the helmet clamping means are not a hazard to another player. Front tab 40 may be about 0.060 inches thick, one inch wide and long enough to underlie the front top bracket 42 of the helmet. The front tab 40 is shaped to be received in a recess on the front of the helmet. Front tab 40 will be clamped in place by screws 41 on the face mask 14 which are received in spaced holes in tab 40. The cover 11 has a recess 43 adjacent the front for receiving top bracket 42 on face mask 14. Tabs 36 may extend through ear ventilation openings 38. The tabs 36 may have a Velcro material 20 attached to their inner surface. The name "Velcro" is a registered trademark owned by Velcro USA, Inc., of Manchester, N.H. Velcro 20 engages Velcro 23, which may be about one inch square, attached to the inside of helmet 12. Thus cover 11 may be removed from the helmet and replaced when worn and it may be replaced by a helmet cover having different resilient properties. Urethane is an example of the resilient material that is suitable for manufacturing the helmet cover.

The helmet 12 is of a conventional type having a top 18, front 25, rear 28, side parts 22 and 24. Front 25, rear 28 and side parts 22 and 24 terminate in a peripheral edge face guard 14 and ear protectors. The helmet cover 11 has a top 16, front 26, sides 27 and 29 and rear 15. Front 26, rear 15 and sides 27 and 29 terminate in a peripheral edge.

The helmet cover is configured so that it is thicker in the areas where impact is customarily greater, providing greater resiliency there. It is also sufficiently thick in the front to protrude forward beyond the edge of the helmet at its face guard attachment points.

Helmet cover 11 terminates at the ear vents, which dispose above the lower edge of the sides 22 and 24 of helmet 12.

The foregoing specification sets forth the invention in its preferred, practical forms but the structure shown is capable of modification within a range of equivalents without departing from the invention which is to be understood is broadly novel as is commensurate with the appended claims.

The embodiment of the invention in which an exclusive property or privilege is claimed are defined as follows:

1. A cover for a helmet comprising an integral elastomeric cover made of a relatively soft resilient foam material encased in an integral outer skin and an integral inner skin, said outer skin being a relatively tough, durable, high abrasion resistant, low friction material, said cover being molded to fit over the top part of a helmet, said helmet having said top, a front, a rear and sides, said front, said rear and said sides of said helmet terminating in a first peripheral helmet edge, said cover having a top, a front, a rear and sides, said front, said rear and said sides of said cover terminating in a second peripheral edge spaced from said first peripheral edge, said helmet cover having fastening means attached to it adjacent said second peripheral edge, said fastening means being adapted to extend into ear ventilation openings and upwardly to said helmet cover and terminate adjacent said second peripheral edge and comprising integral extensions of said outer skin for attaching said cover to said helmet spaced from said first peripheral edge of said helmet whereby said cover can be readily removed from said helmet.

2. The cover recited in claim 1 wherein the interior configuration of said cover is shaped to fit a helmet.

3. The cover recited in claim 2 wherein said cover is made of material having similar properties to urethane material.

4. The helmet cover recited in claim 1 wherein said integral extensions comprises tabs.

5. The helmet cover recited in claim 4 wherein said helmet cover is thickest at said front and tapers rearward to a relatively thin section at said rear.

6. The helmet cover recited in claim 3 wherein said fastening means comprises relatively thin flexible tabs, said tabs are adapted to extend through openings in a helmet, each tab has attaching means thereon adapted to engage attaching means on the inside of said helmet.

7. The cover recited in claim 6 wherein said attaching means comprises Velcro.

8. The cover recited in claim 7 wherein said first mention tabs are disposed in the ear area of said helmet.

9. The cover recited in claim 8 wherein said tabs are integral with said skin material of said helmet.

10. The helmet cover recited in claim 1 wherein said elastomeric material has a density of at least 4 pounds per cubic foot.

11. The helmet cover recited in claim 10 wherein said tabs have a thickness of about 0.060 inches.

12. The helmet cover recited in claim 6 wherein said fastening means further comprises a front tab integral with said skin and disposed at the front of said helmet cover and extending downward and adapted to be disposed between a fastening means on said face mask and the front part of said helmet with fastening means for fastening said face mask to said helmet holding said last mentioned tab in place.

13. The helmet cover recited in claim 1 wherein said, said fastening means comprises a first tab, said first tab comprising a relatively thin flexible first tab member adapted to extend through an ear ventilation opening in said helmet, second fastening means comprising a flexible second tab integrally attached to said skin adjacent a second side of said helmet, a third tab integrally attached to said skin cover at the front thereof.

14. The helmet cover recited in claim 8 wherein a front tab integral with the front part of said helmet cover is provided, said front tab is shaped to be received in a recess in the front part of said helmet and adapted to be clamped between said face mask and said helmet.

15. The helmet cover recited in claim 14 wherein said front tab is clamped to said helmet be means of two spaced screws extending through spaced holes in said front tab.

16. The helmet cover recited in claim 15 wherein said cover has a recess adjacent the front part thereof for receiving said clamping member.

17. In combination, a helmet and cover comprising a helmet cover made of elastomeric foam material, said helmet having a top part, front, sides, rear, a face guard and ear ventilation openings, said face guard being attached to said front of said helmet, said elastomeric foam material being shaped to receive the upper part of said helmet, said helmet cover being shaped to receive said top part, said sides and said rear of said helmet, said helmet cover having a top, sides, front and rear, said helmet cover being thickest in said front and tapering toward said rear and terminating at a rear edge in a relatively thin part at said rear and terminating above said ear ventilation openings of said helmet, said helmet cover terminating in a position above said face guard and is of sufficient thickness to protrude out over said front of said helmet, said helmet cover being molded from a foamable thermoplastic material having an integral inner skin and an integral outer skin being sufficiently thick at said front of said helmet cover to protrude beyond said front of said helmet at said face guard providing greater resiliency where impact is sometimes greater, said cover being attached to said helmet by at least one tab integral with said foam.

18. In combination, a helmet and a cover comprising a helmet cover made of elastomeric foam material, said helmet having a top, a front, sides, a rear and a face guard, said sides each having an ear ventilation opening, said face guard being attached to said front of said helmet by screws, said helmet cover being shaped to receive said top, said sides and said rear of said helmet, said helmet cover being thickest at said front and tapering toward said rear and terminating at a peripheral edge at said rear in a relatively thin part at said rear and terminating above said ear ventilation openings, integral tabs on said cover extending through said ear ventilation openings for removably securing said cover to said helmet, said helmet cover terminating in a position above said face guard and being of sufficient thickness to protrude out over said front of said helmet, said helmet cover being molded from a elastomeric cellular material having an integral inner skin and an integral outer skin.

19. The combination recited in claim 18 wherein said outer skin is a durable, low friction, high abrasion resistant skin surrounding said foam material.

20. The combination recited in claim 19 wherein said helmet cover is made from a urethane material.

* * * * *